US009580276B2

(12) United States Patent
Toutaoui

(10) Patent No.: US 9,580,276 B2
(45) Date of Patent: Feb. 28, 2017

(54) ELEVATOR SYSTEM WITH MESSAGING FOR AUTOMATED MAINTENANCE

(75) Inventor: Mustapha Toutaoui, Berlin (DE)

(73) Assignee: Otis Elevator Company, Farmington, CT (US)

( * ) Notice: Subject to any disclaimer, the term of this patent is extended or adjusted under 35 U.S.C. 154(b) by 403 days.

(21) Appl. No.: 14/350,365

(22) PCT Filed: Oct. 14, 2011

(86) PCT No.: PCT/US2011/056261

§ 371 (c)(1),
(2), (4) Date: Apr. 8, 2014

(87) PCT Pub. No.: WO2013/055346

PCT Pub. Date: Apr. 18, 2013

(65) Prior Publication Data

US 2014/0262629 A1 Sep. 18, 2014

(51) Int. Cl.
*B66B 1/34* (2006.01)
*B66B 5/00* (2006.01)

(52) U.S. Cl.
CPC ..... *B66B 5/0087* (2013.01); *B66B 1/3461* (2013.01); *B66B 5/0025* (2013.01)

(58) Field of Classification Search
CPC .... B66B 5/0087; B66B 1/3461; B66B 5/0025
USPC ..... 187/247, 391, 393
See application file for complete search history.

(56) References Cited

U.S. PATENT DOCUMENTS 3,209,324 A * 9/1965 Diamond ..... B66B 3/00 187/396
3,973,648 A * 8/1976 Hummert ..... B66B 5/0006 187/393
4,512,442 A 4/1985 Moore et al.
4,568,909 A * 2/1986 Whynacht ..... B66B 5/0006 187/393
4,697,243 A * 9/1987 Moore ..... B66B 5/0087 178/4.1 B (Continued)

FOREIGN PATENT DOCUMENTS

EP 2243738 10/2010
GB 2312057 A 10/1997

(Continued)

OTHER PUBLICATIONS

State Intellectual Property Office of People's Republic China, First Search, Application No. 201180074145.0 dated Nov. 20, 2014.

(Continued)

*Primary Examiner* — Anthony Salata
(74) *Attorney, Agent, or Firm* — Carlson, Gaskey & Olds

(57) ABSTRACT

An exemplary elevator system includes a controller that is configured to determine a condition of at least one elevator system component. A message transceiver is coupled with the controller. The message transceiver is configured to send a notification message to a remotely located mobile station that includes an indication of the condition determined by the controller. The message transceiver is configured to receive a response message from the remotely located mobile station that indicates how the controller can address the determined condition.

15 Claims, 5 Drawing Sheets

(56) References Cited

U.S. PATENT DOCUMENTS

| | | | | |
|---|---|---|---|---|
| 4,771,865 | A * | 9/1988 | Hinderling | B66B 5/0006 187/391 |
| 6,330,936 | B1 | 12/2001 | Lence Barreiro et al. | |
| 6,364,066 | B1 * | 4/2002 | Bolch | B66B 5/0018 187/391 |
| 6,439,350 | B1 | 8/2002 | Lence Barreiro et al. | |
| 6,484,125 | B1 | 11/2002 | Huang et al. | |
| 6,543,583 | B1 | 4/2003 | Lence Barreiro et al. | |
| 6,604,611 | B2 | 8/2003 | Liu et al. | |
| 6,854,565 | B2 * | 2/2005 | Perala | B66B 5/0006 187/247 |
| 6,998,995 | B2 | 2/2006 | Nakajima | |
| 7,073,633 | B2 * | 7/2006 | Weinberger | B66B 5/0025 187/247 |
| 7,079,982 | B2 | 7/2006 | Ogura et al. | |
| 7,350,626 | B2 * | 4/2008 | Lence | B66B 1/34 187/247 |
| 7,448,473 | B2 * | 11/2008 | Lindberg | B66B 1/34 187/384 |
| 7,617,029 | B2 | 11/2009 | Loda | |
| 7,699,142 | B1 * | 4/2010 | Wurth | B66B 5/0025 187/247 |
| 8,069,958 | B2 * | 12/2011 | Lence-Barreiro | B66B 1/34 187/247 |
| 8,893,858 | B2 * | 11/2014 | Shi | 187/247 |
| 2003/0000777 | A1 | 1/2003 | Lence Barreiro et al. | |
| 2009/0218178 | A1 | 9/2009 | Lence-Barreiro | |

FOREIGN PATENT DOCUMENTS

| | | | |
|---|---|---|---|
| JP | 2002060152 | A | 2/2002 |
| JP | 2007320703 | A | 12/2007 |
| KR | 1999-0074721 | | 10/1999 |
| KR | 20050057891 | A | 6/2005 |
| KR | 20070091263 | A | 9/2007 |
| WO | 2007045837 | A1 | 4/2007 |
| WO | 2011034527 | A1 | 3/2011 |

OTHER PUBLICATIONS

International Preliminary Report on Patentability for International application No. PCT/US2011/056261 dated Apr. 24, 2014.

International Search Report and Written Opinion of the International Searching Authority for International application No. PCT/US2011/056261 dated Jul. 31, 2012.

European Search Report for European Application No. 11874088.5, received Jun. 22, 2015.

* cited by examiner

ELEVATOR SYSTEM WITH MESSAGING FOR AUTOMATED MAINTENANCE

BACKGROUND

Elevator systems typically require periodic maintenance, repair or both. Routine maintenance typically occurs on a scheduled basis. The type of elevator system and the components that are installed typically dictate the maintenance schedule. The actual need for maintenance, however, is typically dictated by use of the elevator system. Preset maintenance schedules, therefore, can result in maintenance being performed before it is necessary. This introduces additional cost and takes up the time of elevator mechanics who might otherwise perform other services on other systems.

For purposes of repairing an elevator system a mechanic typically has to visit the installation, diagnose the situation and take any corrective action that may be required.

There have been advances in remote elevator monitoring including communications between elevator systems and central control facilities that are located remotely from the installation of the elevator system. In most instances, however, there still is a need for dispatching a mechanic to the elevator system to perform the required repair or adjustment.

SUMMARY

An exemplary elevator system includes a controller that is configured to determine a condition of at least one elevator system component. A message transceiver is coupled with the controller. The message transceiver is configured to send a notification message to a remotely located mobile station that includes an indication of the condition determined by the controller. The message transceiver is configured to receive a response message from the remotely located mobile station that indicates how the controller can address the determined condition.

In one example, the message transceiver is a short message service (SMS) transceiver and the notification and response messages each comprise a SMS message. The notification message provides a mechanic with an indication of a current condition of at least one component of the elevator system. The response message allows the mechanic to provide an indication to the controller of the elevator system for automatically responding to the condition that is the subject of the notification message.

An exemplary method of addressing a condition of an elevator system includes using a controller of the elevator system to determine a condition of at least one component of the elevator system. The controller communicates with a message transceiver regarding the determined condition. The message transceiver sends a notification message to a remotely located mobile station. The notification message includes an indication of the determined condition. A response message received from the remotely located mobile station indicates how the controller can address the determined condition.

The various features and advantages of a disclosed example embodiment will become apparent to those skilled in the art from the following detailed description. The drawings that accompany the detailed description can be briefly described as follows.

DETAILED DESCRIPTION

Figure 1:
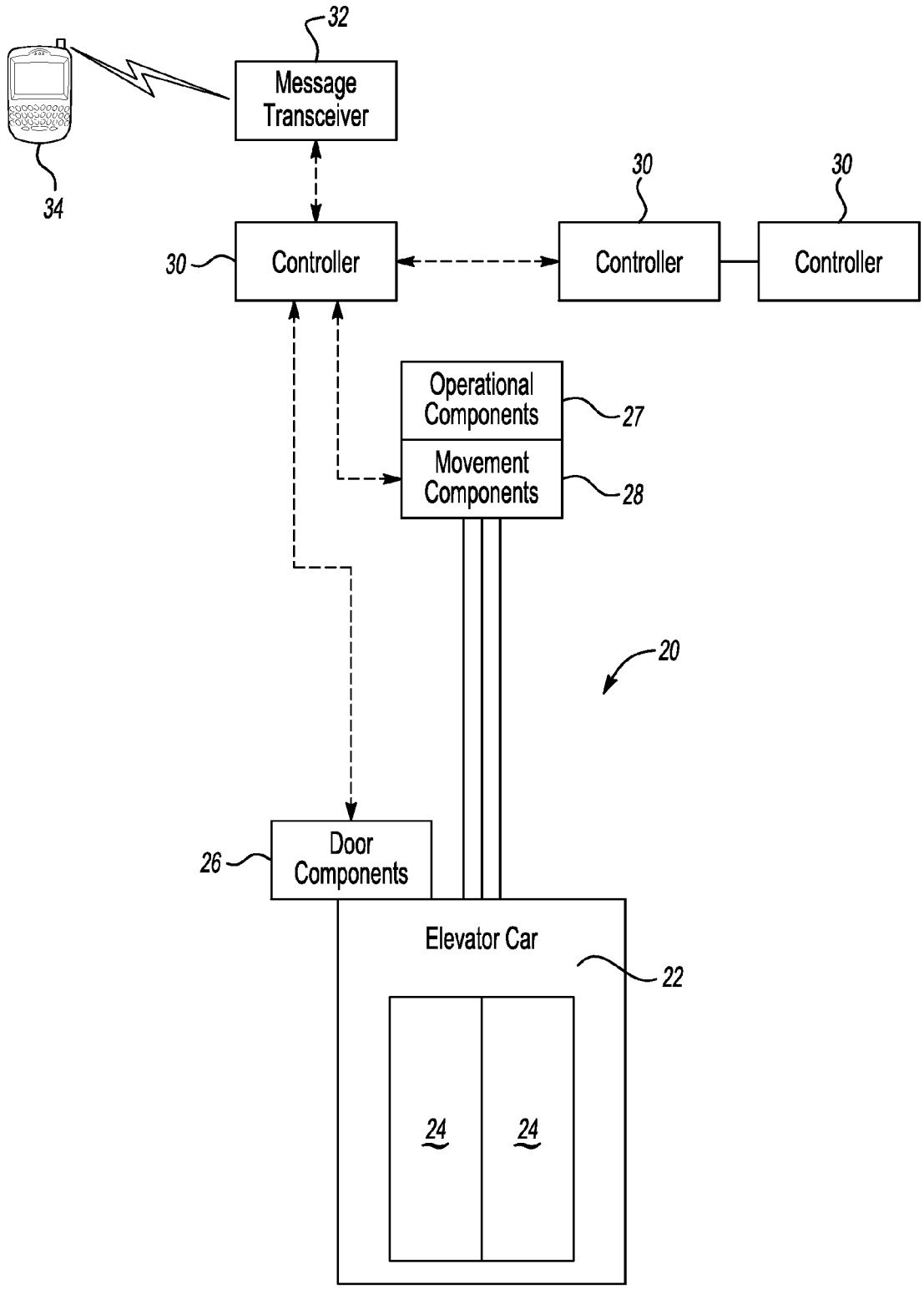
FIG. 1 schematically illustrates selected portions of an elevator system designed according to an embodiment of this invention.

FIG. 1 schematically shows selected portions of an elevator system 20. An elevator car 22 is situated for carrying passengers between various landings in a building, for example. The elevator car 22 includes doors 24 and associated door components 26 that control passenger access to the elevator car 22. The door components schematically shown at 26 include components such as a door moving mechanism, door locks, door switches that indicate an open or closed condition of a door and other components associated with elevator doors.

The elevator system 20 includes a plurality of operational components 27. Example components schematically represented at 27 include a printed circuit board.

Movement of the elevator car 22 depends upon the operation of movement components schematically shown at 28. Example elevator system movement components include a machine, motor, brake, drive, hoisting ropes, sheaves and other components used for moving the elevator car 22.

A controller 30 is configured to control operation of the elevator system 20, in part, by determining a condition of at least one of the elevator system components. The controller 30 is configured to determine when an elevator system component is malfunctioning or if there is a problem associated with a component, for example. Given this description and known techniques for programming a controller to determine elevator system component conditions, those skilled in the art will be able to realize a controller that will perform the functions of the example controller 30 in a manner that meets the needs of their particular situation.

The controller 30 communicates with a message transceiver 32 that is configured to wirelessly communicate with a mobile station 34. The message transceiver 32 is configured to send notification messages to the mobile station 34 regarding conditions determined by the controller 30. The message transceiver 32 is also configured to receive response messages from the mobile station 34 that include an indication of how the controller 30 can address a determined condition that is the subject of a notification message. The illustrated example arrangement allows for using wireless communication techniques such as messaging services to facilitate automated elevator system maintenance and repair in a manner that does not require a mechanic visiting the site of the elevator system to perform diagnosis and adjustment, for example.

In one example, the message transceiver 32 communicates with the mobile station 34 over a wireless link available through a conventional cellular phone service provider. The messages transmitted between the mobile station 34 and the message transceiver 32 in one example comprise short message service (SMS) messages. In one such example, the mobile station 34 comprises a cellular phone or a smart phone.

With the illustrated example, a mechanic or technician can receive a message regarding a condition of an elevator system, determine whether some action taken by the elevator system itself might address that condition and send a message that serves as an instruction to the elevator system for addressing the condition. The illustrated example allows for utilizing the knowledge and experience of the mechanic without requiring a mechanic to be onsite at the location of the elevator system and without requiring the mechanic to perform any action for addressing a system that the mechanic becomes aware of through a notification message received on the mobile station 34.

Figure 2:
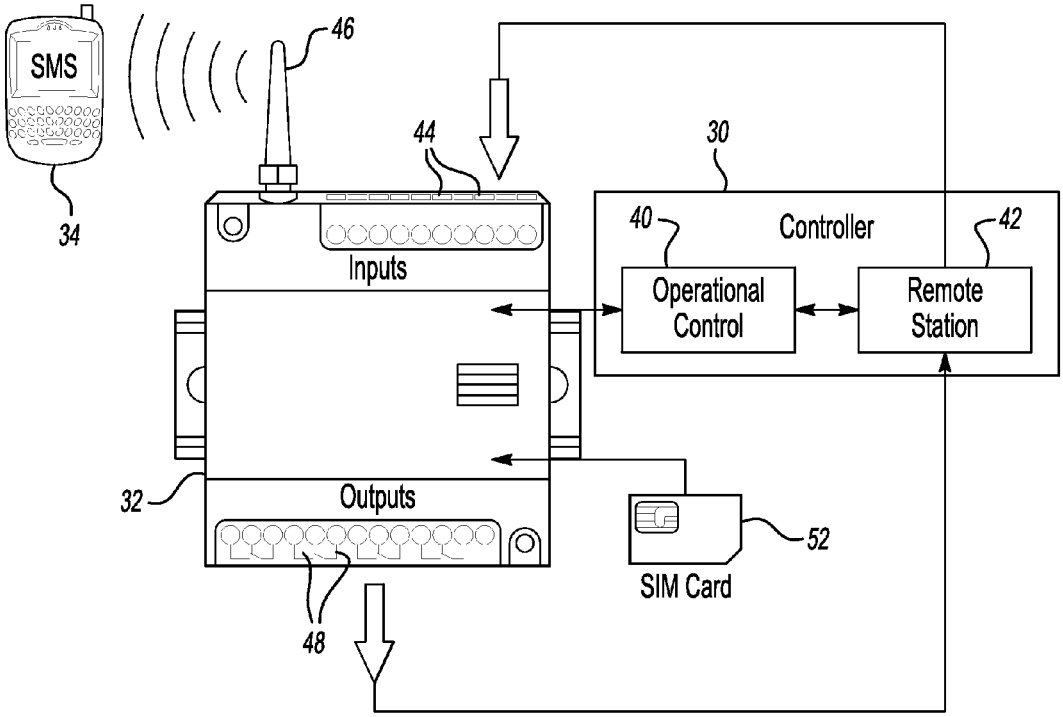
FIG. 2 schematically illustrates selected portions of the example of FIG. 1.

FIG. 2 schematically illustrates selected features of the example message transceiver 32 and controller 30. In this example, the controller 30 includes an operational control portion 40 that is responsible for elevator system operation. A remote station portion 42 is responsible for communications outside of the elevator system for purposes of reporting a condition of the elevator system and automatically addressing that condition if appropriate. The controller 30 is linked with the message transceiver 32 in this example using a serial interface comprising a hardwired connection between the controller 30 and the message transceiver 32. In this example, the transceiver 32 includes a plurality of inputs 44 through which the transceiver 32 receives indications from the controller 30 regarding conditions of the elevator system as determined by the controller 30. The transceiver 32 includes an antenna 46 for wireless communications with the remotely located mobile station 34 over a wireless link facilitated by a cellular phone service provider, for example.

In one example, the remote station portion 42 includes memory that has a plurality of predetermined SMS messages. The controller 30 selects an appropriate message from the memory and provides it to the transceiver 32, which transmits that message to one or more remotely located mobile stations 34. In some examples, each of the plurality of inputs 44 is dedicated to a particular type of condition that can be determined by the controller 30.

The example transceiver 32 includes a plurality of outputs 48 in communication with the remote station portion 42 of the controller 30. When a response message is received from the mobile station 34, the transceiver 32 provides an indication regarding the response message to the controller 30. In some examples, the actual content of the response message will be provided directly to the controller 30. The controller 30 is programmed to recognize the content of a response message and to take action following a corresponding instruction indication, for example.

The illustrated example transceiver portion 32 is configured as a cellular communication device having its own subscriber identity module (SIM) card 52, which allows for the message transceiver 32 to communicate over wireless channels facilitated by cellular communication service providers, for example. The SIM card 52 in the illustrated example works like a SIM card included in a mobile station, for example.

As illustrated in FIG. 1, a single message transceiver 32 may be associated with a plurality of elevator controllers 30. Any notification message in such an example identifies the controller or elevator system from which it is coming and any response message contains the corresponding identifier so that the appropriate communications between a mechanic and an elevator system controller occur even when the transceiver 32 is used for a plurality of controllers and is capable of communicating with a plurality of mobile station devices.

In this example, a serial connection between controllers facilitates communications with the transceiver 32. The controller 30 linked directly to the transceiver (i.e., without any other intervening controllers between it and the transceiver 32) serves as a master controller while the others are slaves for purposes of communications through the transceiver 32. Such a serial arrangement conserves wiring for connecting the transceiver 32 to a plurality of controllers 30.

A single transceiver 32 also may communicate with a plurality of mobile stations 34 when a corresponding plurality of predetermined phone numbers for those mobile stations is programmed into the transceiver 32.

Figure 3:
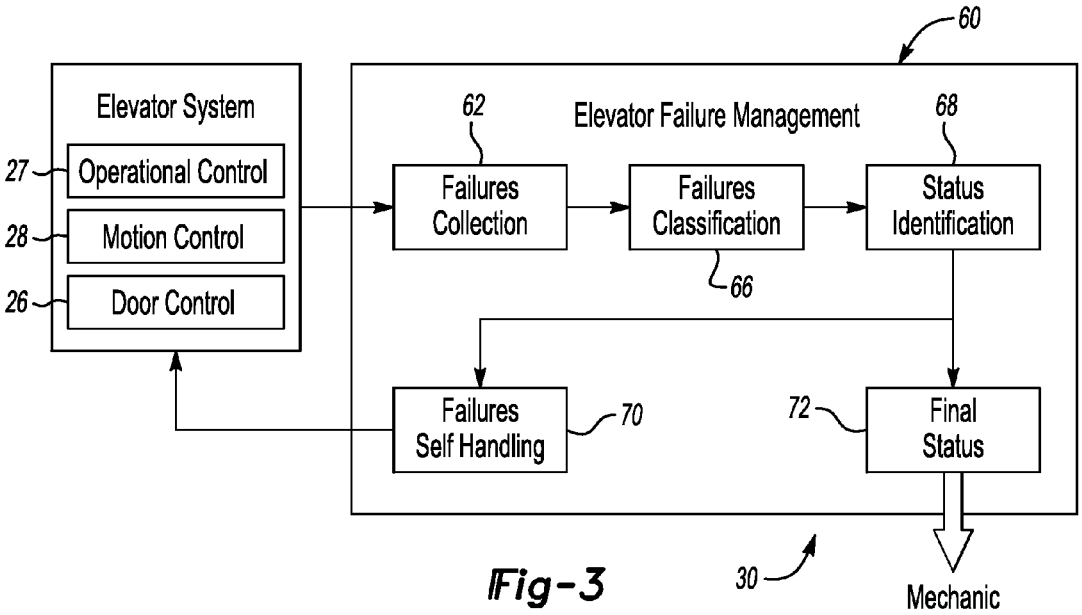
FIG. 3 schematically illustrates a communication strategy useful with an example embodiment of this invention.

FIG. 3 schematically illustrates a technique for handling the information for the content that will be provided in the notification messages sent by the transceiver 32. An elevator failure management module 60 of the controller 30 processes information regarding various components of the elevator system. A failures collection portion 62 obtains information from different components in the elevator system that indicates a condition of one or more of those components associated with a failure to operate as intended. For example, if a door is not closed when it should be, the door lock indicator at that door will provide information to the controller 30. If there is undesired noise or vibration during elevator car movement, an appropriate sensor will provide such information. Operational control as schematically shown at 27 may be associated with communications between elevator system components, operation of a car operating panel or similar features, for example.

Once the failure condition information has been collected at 62 it will be classified at 66. One example includes classifying the information as pertaining to a need for elevator maintenance, pertaining to a condition in which an elevator is blocked or pertaining to a condition in which an elevator is running but with disturbances. Classifying the condition allows for identifying the status of the elevator system component at 68.

In some examples, the controller 30 may be able to take action to address the situation as schematically shown at 70 by activating a component reset, for example. Whenever it is necessary to send a notification message, the determined status of the component is communicated through a notification message such as a SMS message. The status information determined by the controller 30 is shown at 72 in FIG. 3.

Figure 4:
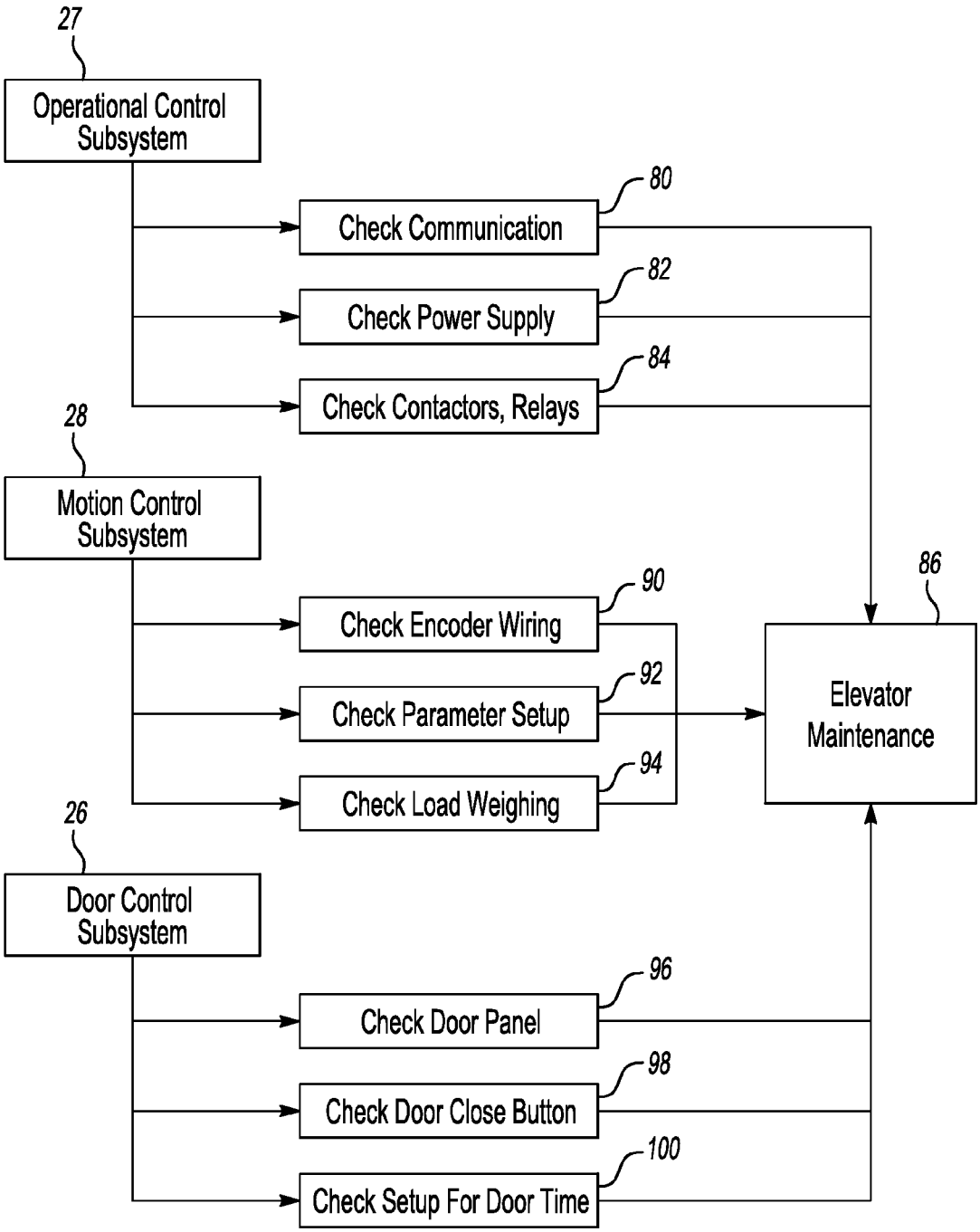
FIG. 4 schematically illustrates a strategy for classifying a condition of an elevator system.

FIG. 4 schematically illustrates an example strategy for identifying a determined condition as pertaining to a need for elevator maintenance. For example, component information from the operational control subsystem schematically shown at 64 is analyzed by checking communication at 80, checking power supply information at 82 and checking contactors or relays at 84. If any of those checks reveals a problem, a notification message regarding elevator maintenance as shown at 86 is warranted.

Example determinations regarding components associated with the motion control subsystem 28 includes checking encoder wiring at 90, checking parameter setup at 92 and checking load weighing at 94. If one or more of those checks reveals a deviation from a desired performance, a notification message indicating a need for elevator maintenance will be sent.

Example determinations regarding the door control subsystem schematically shown at 26 include checking door panels at 96, checking door close buttons at 98 and checking the setup for door time at 100.

Given this description, those skilled in the art will realize other determinations or conditions to include for purposes of generating a notification message.

Figure 5:
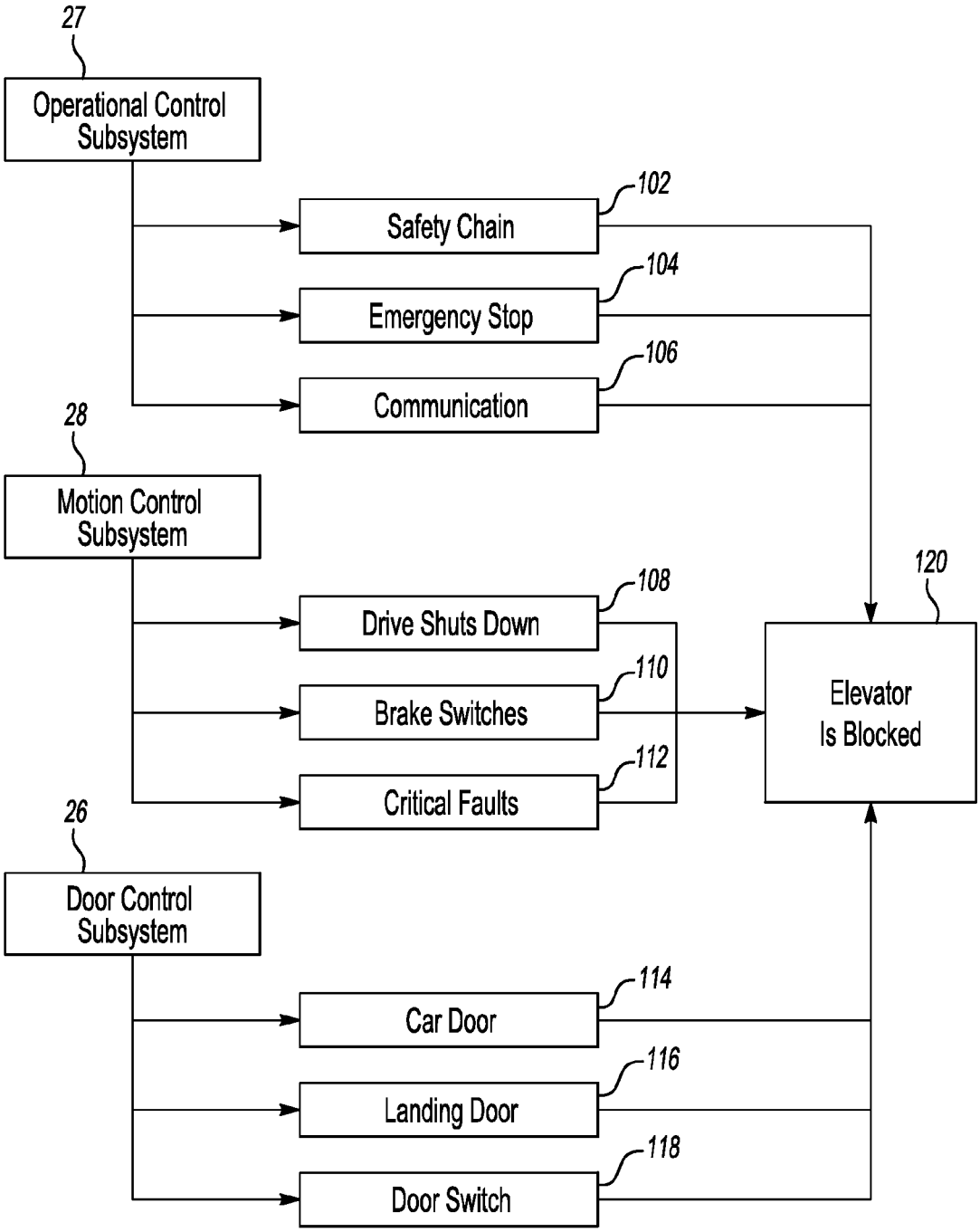
FIG. 5 schematically illustrates a strategy for classifying another elevator system condition.

FIG. 5 schematically illustrates example considerations for identifying when an elevator is blocked and requires attention. Example checks associated with the operational control subsystem 64 include checks of the status of the safety chain 102, the emergency stop components 104 and communication components 106. Portions of the motion control subsystem 28 that may be considered include determining whether the elevator drive shuts down at 108, whether brake switches are operational at 110 and whether there are any critical faults at 112. Example door control subsystem considerations include checking whether car doors are operational or in an appropriate position, checking landing doors at 116 and verifying the operation of door switches at 118. If there is a deviation in the performance of any of those from a desired performance, the status that the elevator is blocked is determined at 120 for purposes of sending a correspondingly appropriate notification message.

Figure 6:
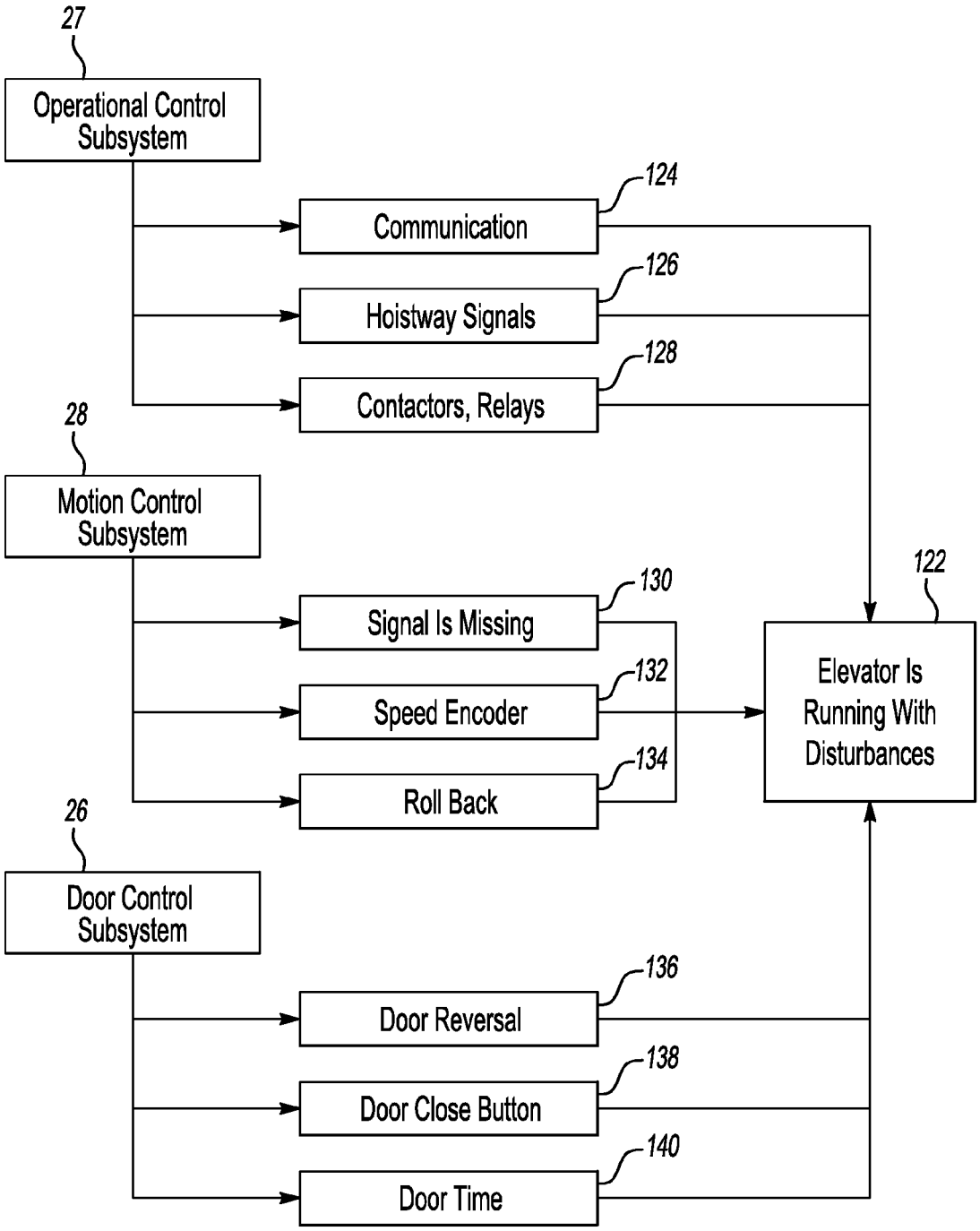
FIG. 6 schematically illustrates a strategy for classifying another elevator system condition.

FIG. 6 schematically illustrates a technique for determining when the status of the elevator system corresponds to the elevator running or operating but with disturbances as represented at 122. Example operational control subsystem considerations in this regard include communications at 124, hoistway signals at 126 and contactors or relays at 128. Example motion control subsystem considerations include determining whether any signals are missing at 130, whether a speed encoder is providing appropriate information at 132 and whether there is any undesired rollback at 134. Door control subsystem components include determining whether there is appropriate door reversal at 136, whether a door close button is operating at 138 and monitoring door time such as the amount of time it takes for a door to open or close at 140. Whenever there is a deviation between desired, predetermined conditions and conditions identified by the controller 30, that results in a determination that a notification message should be sent including an indication that the elevator is running but with disturbances.

The illustrated example allows for detecting elevator failures and operating conditions in an automated fashion and allowing for a mechanic or technician to remotely react to those determinations for purposes of making an adjustment in the operation or condition of one or more elevator system components. In some cases, a mechanic may direct the controller 30 to take corrective action by sending an appropriate response message without requiring the mechanic to arrive on site. This facilitates returning an elevator car to service more quickly and, for example, allows a trapped passenger to exit an elevator car much sooner than a mechanic would be able to arrive at the location of the elevator system.

In some examples, the controller 30 provides a notification that a response message was received with updated condition information in a follow-up notification message sent by the transceiver 32. This allows a mechanic to verify correction or to determine a need for further attention.

In some examples the mechanic may send an inquiry message to the transceiver 32 requesting status information from the controller 30. This allows a mechanic to evaluate an elevator system remotely even when the controller 30 has not determined that a notification message should be sent.

One of the features of the illustrated example is that it takes advantage of existing communication technology and provides an economical solution for addressing elevator maintenance, service and repair requirements anywhere where cellular communication services are available.

The preceding description is exemplary rather than limiting in nature. Variations and modifications to the disclosed example may become apparent to those skilled in the art that do not necessarily depart from the essence of this invention. The scope of legal protection given to this invention can only be determined by studying the following claims.

I claim:

1. An elevator system, comprising:

a controller configured to determine a condition of at least one elevator system component, the controller classifying the determined condition as one of (i) pertaining to a need for elevator maintenance, (ii) pertaining to a condition in which an elevator is blocked, or (iii) pertaining to a condition in which an elevator is running with disturbance; and a message transceiver coupled with the controller, the message transceiver being configured as a cellular communication device to utilize a cellular communication service to send a notification message to a remotely located mobile station that includes an indication of the condition determined and classified by the controller without requiring a mechanic to be onsite at the location of the elevator system, the message transceiver being configured to receive a response message from the remotely located mobile station that indicates how the controller can address the determined condition.

2. The elevator system of claim 1, wherein the message transceiver comprises a cellular communication short message service (SMS) transceiver, the notification message comprises a SMS message and the response message comprises a SMS message.

3. The elevator system of claim 1, wherein the controller includes a memory including a plurality of predetermined messages and the controller selects one of the predetermined messages as the notification message responsive to the determined condition.

4. The elevator system of claim 3, wherein the message transceiver comprises a plurality of inputs;

the controller is coupled to each of the inputs; and the controller provides an indication on a selected one of the inputs depending on a category of the determined condition.

5. The elevator system of claim 1, wherein the controller determines a content of the response message received from the remote mobile station; and the controller causes a response to the determined condition responsive to the corresponding indication.

6. The elevator system of claim 5, wherein the response message includes an indication of one of a plurality of predetermined controller commands.

7. The elevator system of claim 1, comprising:

a plurality of controllers each configured to determine a condition of at least one elevator system component associated with the controller, each of the controllers being in communication with the message transceiver; and wherein the message transceiver is configured to send a notification message to a remotely located mobile station that includes an indication of a condition determined by any of the controllers, the message transceiver being configured to receive a response message from the remotely located mobile station that indicates how the corresponding controller can address the determined condition.

8. The elevator system of claim 7, wherein at least one of the controllers is configured to identify which of the controllers is the intended recipient of a received response message and to communicate with the intended recipient controller regarding the received response message.

9. A method of addressing a condition of an elevator system, comprising the steps of:

using a controller of the elevator system to determine a condition of at least one component of the elevator system;

classifying the determined condition as one of (i) pertaining to a need for elevator maintenance, (ii) pertaining to a condition in which an elevator is blocked, or (iii) pertaining to a condition in which an elevator is running with disturbance;

communicating between the controller and a message transceiver regarding the determined and classified condition;

sending a notification message from the message transceiver utilizing a cellular communication service to a remotely located mobile station without requiring a mechanic to be onsite at the location of the elevator system, the notification message including an indication of the determined condition; and receiving a response message from the remotely located mobile station that indicates how the controller can address the determined condition.

10. The method of claim 9, wherein the notification message comprises a cellular communication short message service (SMS) message and the response message comprises a SMS message.

11. The method of claim 9, wherein the controller includes a memory including a plurality of predetermined messages and the method includes selecting one of the predetermined messages as the notification message responsive to the determined condition.

12. The method of claim 11, wherein the message transceiver comprises a plurality of inputs and the controller is coupled to each of the inputs;

and wherein the method comprises:

selecting one of the inputs depending on a category of the determined condition; and providing an indication from the controller on the selected one of the inputs.

13. The method of claim 9, wherein the controller determines a content of the response message received from the remote mobile station; and causes a response to the determined condition responsive to the corresponding indication.

14. The method of claim 9, comprising:

communicating between the message transceiver and a plurality of elevator controllers;

sending notification messages from the message transceiver on behalf of any of the controllers that determines a condition of an associated elevator component;

receiving response messages at the message transceiver; and providing a corresponding indication to one of the controllers determined to be an intended recipient of a received response message.

15. The method of claim 9, comprising communicating the notification and response messages over a wireless link between the message transceiver and the remote mobile station.

* * * * *